US009428327B2

(12) United States Patent
Liu et al.

(10) Patent No.: US 9,428,327 B2
(45) Date of Patent: Aug. 30, 2016

(54) LUMINOUS SYRINGE

(71) Applicant: GUAN DAI TECHNOLOGY COMPANY LTD., Tainan (TW)

(72) Inventors: Ke-Chuan Liu, Tainan (TW); Jeremy Thompson, Collierville, TN (US); Jessica Thompson, Collierville, TN (US)

(73) Assignee: Guan Dai Technology Company, Ltd., Tainan (TW)

( * ) Notice: Subject to any disclaimer, the term of this patent is extended or adjusted under 35 U.S.C. 154(b) by 0 days.

(21) Appl. No.: 14/603,688

(22) Filed: Jan. 23, 2015

(65) Prior Publication Data

US 2016/0214786 A1 Jul. 28, 2016

(51) Int. Cl.

| | |
|---|---|
| ***B65D 5/66*** | (2006.01) |
| ***B65D 85/72*** | (2006.01) |
| ***B65D 41/02*** | (2006.01) |
| ***B65D 83/00*** | (2006.01) |
| ***F21K 2/06*** | (2006.01) |

(52) U.S. Cl.

CPC ..... *B65D 85/72* (2013.01); *B65D 41/02* (2013.01); *B65D 83/0005* (2013.01); *F21K 2/06* (2013.01)

(58) Field of Classification Search

CPC .. B65D 85/72; B65D 41/02; B65D 83/0005; F21K 2/00; F21K 2/06; A61M 2205/6081; A61M 2205/587; A61M 2205/60; A61M 2205/6009; A61M 2205/6063; A61C 1/088; A47G 2019/238

USPC ..... 222/113; 362/34; 604/189; 446/219

See application file for complete search history.

(56) References Cited

U.S. PATENT DOCUMENTS

| | | | | |
|---|---|---|---|---|
| 3,811,441 | A * | 5/1974 | Sarnoff | A61M 5/24 604/201 |
| 5,171,081 | A * | 12/1992 | Pita | A47G 19/025 362/101 |
| 5,931,383 | A * | 8/1999 | Palmer | A47G 21/182 239/33 |
| 6,062,380 | A * | 5/2000 | Dorney | A47G 19/2227 206/217 |
| 6,676,269 | B1 * | 1/2004 | Dorney | A47G 19/2227 362/101 |
| 2003/0076673 | A1 * | 4/2003 | Diak/Ghanem | A47G 19/2227 362/101 |
| 2005/0080384 | A1 * | 4/2005 | Green | A61M 5/31511 604/218 |
| 2005/0092646 | A1 * | 5/2005 | Cohen | B65D 23/00 206/527 |
| 2006/0056167 | A1 * | 3/2006 | Weigl | A47G 21/02 362/34 |
| 2006/0222806 | A1 * | 10/2006 | Burchett | A63H 27/10 428/64.1 |
| 2009/0207582 | A1 * | 8/2009 | Dorsey | F21K 2/06 362/34 |
| 2010/0014275 | A1 * | 1/2010 | Cranor | F21K 2/06 362/34 |

* cited by examiner

*Primary Examiner* — J. Casimer Jacyna
*Assistant Examiner* — Benjamin R Shaw
(74) *Attorney, Agent, or Firm* — Rosenberg, Klein & Lee

(57) ABSTRACT

A luminous syringe comprises a syringe main body with a hollow chamber formed inside. A mezzanine space is formed between an outer wall of the syringe main body and the hollow chamber, and a light emitting agent and at least one catalyst tube are received within the mezzanine space. A cap is used to close the opening formed on the mezzanine space, and a plunger is provided within the hollow chamber. When in use, a force is applied to press a locating rib on the outside wall of the syringe main body to break the catalyst tube, so that a catalyst came out from the tube is mixed up with the light emitting agent to emit fluorescent light. Then, the syringe is used to draw beverage like coke, cocktail into the hollow chamber and the plunger is pushed by hand to inject the beverage out for drinking.

13 Claims, 4 Drawing Sheets

LUMINOUS SYRINGE

BACKGROUND OF INVENTION

1. Field of the Invention

The present invention relates to a luminous syringe, more particularly to a luminous syringe which is used to increase the fun in drinking beverage and playing in nightclub.

2. Brief Description of the Prior Art

In order to relieve the pressure of life and work or to divert his mind from boredom and loneliness, modern people often meet with a few friends or alone, after evening off hours, to night entertainment place (nightclub in short) such as karaoke, bar, pub, club or hotels and enjoys listening to music, drinking and fun, relaxing or making new friends.

In order to attract more consumers coming to visit, nightclubs such as bar, pub or club not only have to enhance hardware decoration and the quality of audio equipment but also have to launch new amusement theme activities so as to meet preference of novelties and changing needs of modern people. Accompanying with the prevalence of subculture events such as Cosplay, nightclubs also rise a wave of role-playing such that customers can either wear costumes, or do the makeup, or imitate body language or use props of the role, to mimic the role they want to play in order to experience the feeling different from daily life or work. Among which, the role-play of doctor, nurse and patient become more and more welcomed by customers. If props such as stethoscope or syringe are further used, more fun can be added to the play.

However, most of nightclubs are dimly lighted. Even when people takes syringe and other props, it is difficult to see clearly in dimly lighted environment that often reduces the sense of fun to play. On the other hand, if the light is made to be brighter, this is easy to create a sense of restraint among the customers and make it difficult to relax or to have fun.

In view of the above disadvantages, the inventor proposes the present invention, with a purpose to improve the defect of being unable to see clearly the syringe or other props taken by customers in dimly lighted environment, according to his abundant experience and knowledge in product development and manufacturing in relevant field

SUMMARY OF THE INVENTION

The main object of the present invention is to provide a luminous syringe which is used in nightclub to increase the fun in drinking beverage and playing.

The above object of the present invention is achieved by the luminous syringe described as below.

The luminous syringe according to the present invention comprises: a syringe main body having a closed front end, a opened rear end and a hollow chamber formed inside; a hollow orifice protruding from the front end of the syringe main body and communicating with the hollow chamber; a plunger provided within the hollow chamber; characterized in that: a mezzanine space is formed between the outer wall of the syringe main body and the hollow chamber, a light emitting agent and at least one catalyst tube being received within the mezzanine space; a catalyst being contained within the tube body of the catalyst tube; a cap being provided to close the opening formed on the mezzanine space at the rear end of syringe main body; an aperture being formed on the center of the cap to correspond to the hollow chamber, and the plunger being penetrated through the aperture.

The luminous syringe as stated above, wherein the mezzanine space of the syringe main body is formed with at least one locating recess within which the catalyst tube is received.

The luminous syringe as stated above, wherein the syringe main body has at least one locating rib formed axially on its outer peripheral wall, and the side wall of the mezzanine space of the syringe main body is formed with at least one locating groove corresponding to the locating rib, so that the catalyst tube is received within the locating groove.

The luminous syringe as stated above, wherein the peripheral edge at the rear end of the syringe main body is formed with a fixing flange and a fixing groove is provided on the end face of the fixing flange; a notch is provided on at least one side of the fixing groove, and the cap correspondingly covers on the fixing groove of the fixing flange; the cap has a lug provided on at least one side thereof so as to be disposed correspondingly on the notch for positioning.

The luminous syringe as stated above, wherein the cap further has an abutting edge formed at its bottom along the periphery of the aperture for abutting against the hollow chamber of the syringe main body for positioning.

The luminous syringe as stated above, wherein the light emitting agent is oxalate compound, and the catalyst is activator.

Configuring like this, when in implementation, a force is applied to press the locating rib provided on the outer peripheral wall of the syringe main body to break the catalyst tube provided within the mezzanine space, so that the catalyst coming out from the catalyst tubes is mixed up with the light emitting agent within the mezzanine space. Then, beverage like cocktail or coke is drawn into the hollow chamber of the syringe main body through the orifice. Thus, the beverage can be ejected from the syringe main body for drinking by pushing the plunger to move in the hollow chamber. In this manner, the drinking style by syringe and the fluorescent light emitted from the syringe main body can enhance the fun to play in dimly lighted environment of nightclubs.

BRIEF DESCRIPTION OF ACCOMPANYING DRAWINGS

DETAILED DESCRIPTION OF PREFERRED EMBODIMENTS

The objects, the technical contents and the expected effectiveness of the present invention will become more apparent from the detailed description of the preferred embodiment in conjunction with the accompanying drawings.

Figure 1:
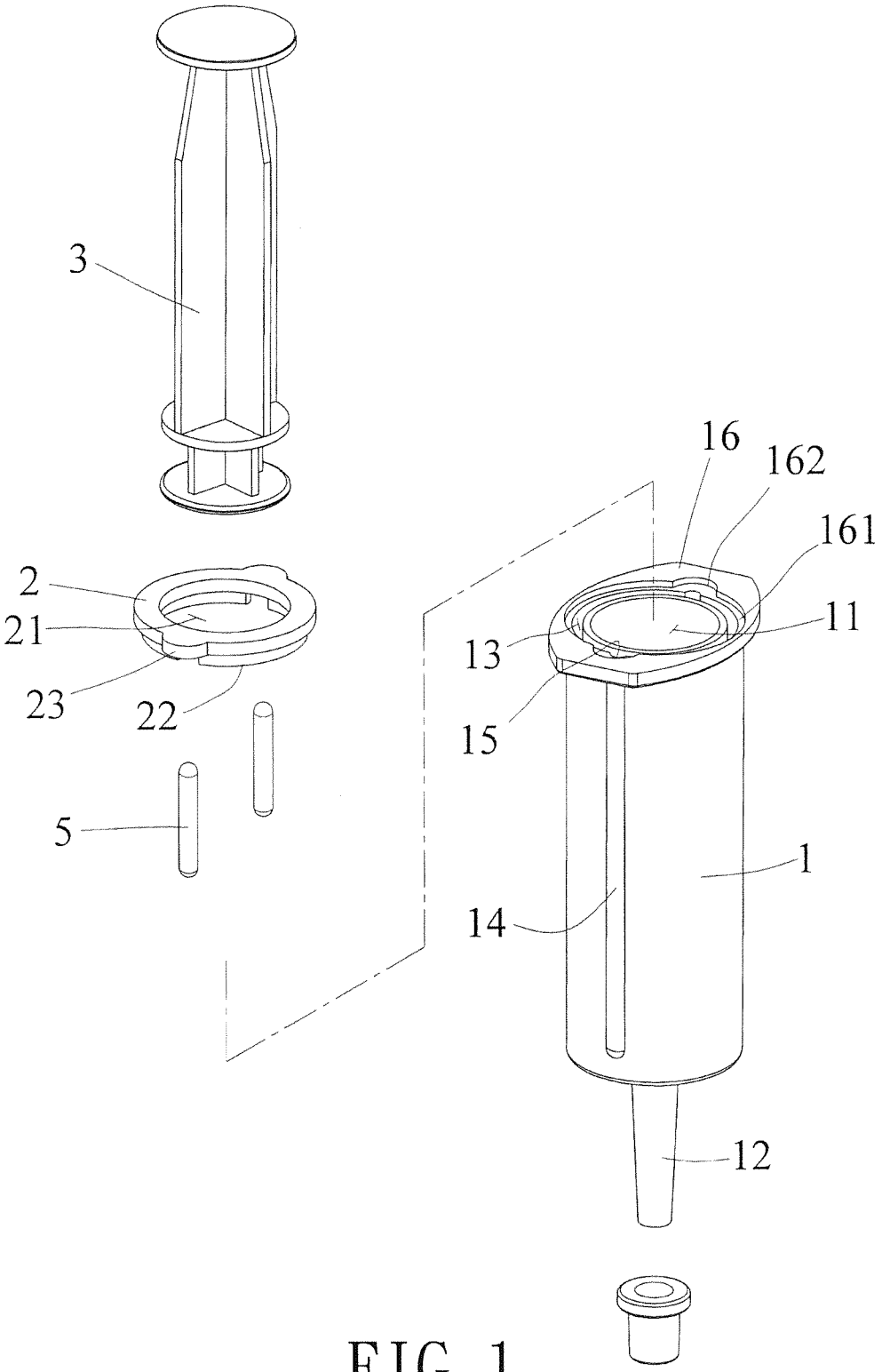
FIG. 1 is a first perspective exploded view of the present invention.
Figure 2:
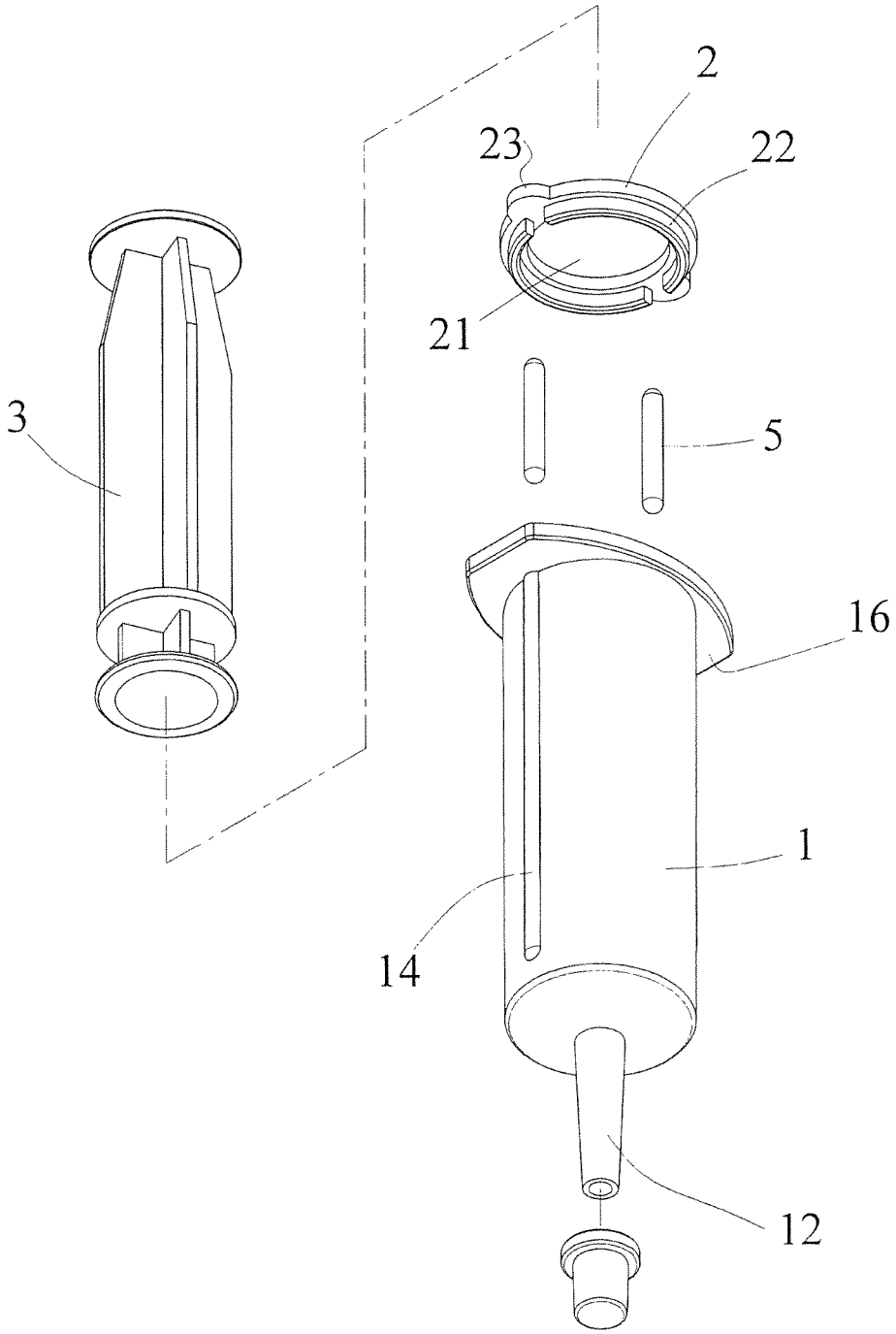
FIG. 2 is a second perspective exploded view of the present invention.
Figure 3:
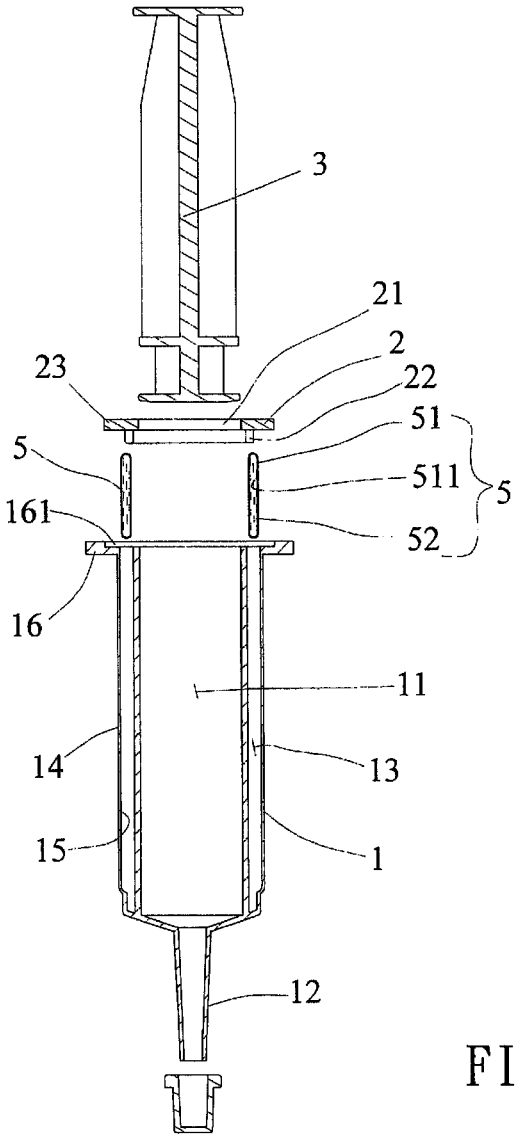
FIG. 3 is a first sectional view of the present invention.
Figure 4:
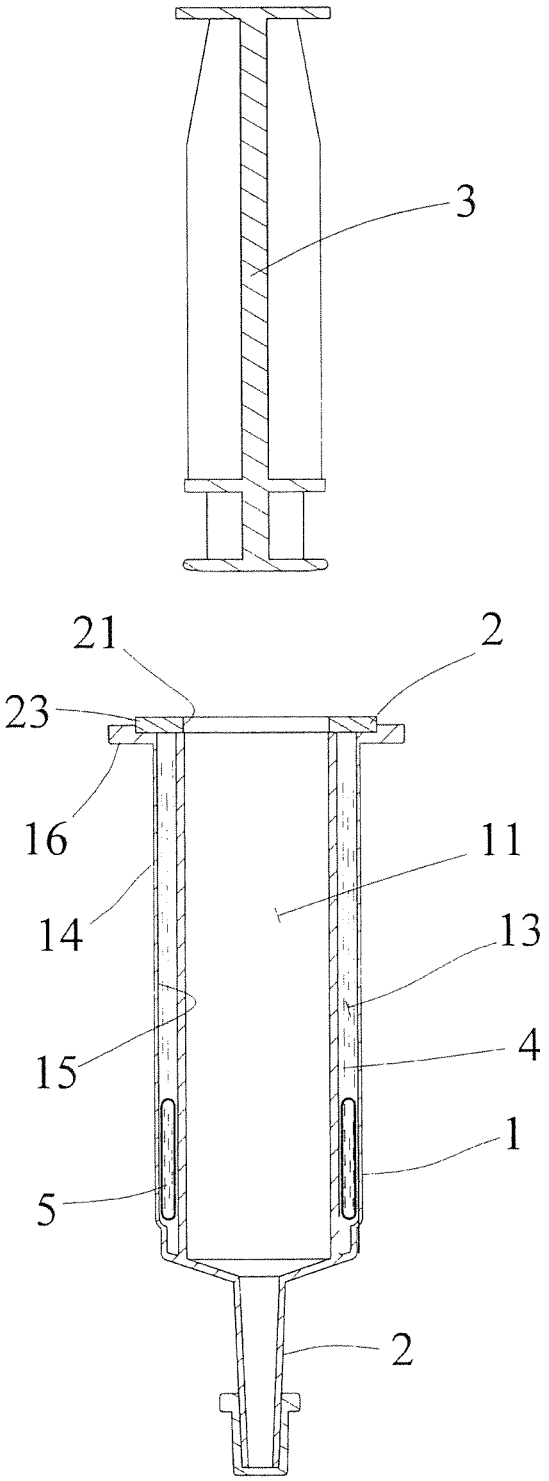
FIG. 4 is a second sectional view of the present invention.

Firstly referring to FIGS. 1 to 4, the luminous syringe of the present invention comprises a syringe main body (1), a cap (2), a plunger (3), a light emitting agent (4) and a catalyst tube (5).

The syringe main body (1) has a closed front end, an opened rear end and a hollow chamber (11) formed inside. A hollow orifice (12) is protruded from the front end of the syringe main body (1) and is communicated with the hollow chamber (11). Further, a mezzanine space (13) is formed between the outer wall of the syringe main body (1) and the hollow chamber (11). The syringe main body (1) has at least one locating ribs (14) formed axially on its outer peripheral wall, and the side wall of the mezzanine space (13) of the syringe main body (1) is formed with at least one locating groove (15) corresponding to the locating rib (14). Furthermore, the peripheral edge at the rear end of the syringe main body (1) is formed with a fixing flange (16) and a fixing groove (161) is provided on the end face of the fixing flange (16), a notch (162) is provided integrally on at least one side of the fixing groove (161) and the notch (162) is made to correspond to the locating groove (15).

The cap (2) correspondingly covers on the fixing groove (161) of the fixing flange (16) so as to close the opening formed on the mezzanine space (13) at the rear end of the syringe main body (1). An aperture (21) is formed on the center of the cap (2) to correspond to the hollow chamber (11) of the syringe main body (1), and the cap (2) further has an abutting edge (22) formed at its bottom along the periphery of the aperture (21) for abutting against the hollow chamber (11) of the syringe main body (1) for positioning. The cap also has a lug (23) provided on at least one side thereof so as to be disposed correspondingly in the notch (162) for positioning.

The plunger (3) is fitted through the aperture (21) of the cap (2) into the hollow chamber (11) of the syringe main body (1).

The light emitting agent (4) is received within the mezzanine space (13) of the syringe main body (1), and the light emitting agent (4) is oxalate compound.

The catalyst tube (5) is disposed in the locating groove (15). The catalyst tube (5) has a tube body (51) with two ends closed and the tube body (51) is a glass tube. An inner core (511) of the tube body (51) is filled with a catalyst (52) which can be an activator.

When in assembly, the light emitting agent (4) is firstly injected into the mezzanine space (13) of the syringe main body (1), and then the catalyst tube (5) is disposed in the locating groove (15). The cap (2) is assembled on the fixing groove (161) of the syringe main body (1) and is combined integrally with the syringe main body (1) by high frequency plastic welder. Finally, the plunger (3) is fitted into the hollow chamber (11) of the syringe main body (1) and the assembly is thus accomplished.

When the luminous syringe is used in nightclub as a props for playing, user can apply a force to press the locating rib (14) provided on the outer wall of the syringe main body (1), so that the tube body (51) of the catalyst tube (5) provided in the locating groove (15) is broken by the force. Thus, the catalyst (52) filled in the tube bodies (51) comes out and is mixed up with the light emitting agent (4) received in the mezzanine space (13) of the syringe main body (1) to trigger chemical reaction therewith so as to emit fluorescent light out. Therefore, people can see clearly the whole syringe main body (1) in luminous state under dimly lighted environment of nightclub. Next, user can pull the plunger (3) upward to draw up such beverage as beer, coke or cocktail into the hollow chamber (11) through the orifice (12) at the front end of the syringe main body (1), then user can push the plunger (3) forward till the front end of the syringe main body (1) so that the beverage such as beer, coke or cocktail contained in the hollow chamber (11) is injected out for drinking by user or friends nearby. In this manner, the fun of play in nightclubs can be enhanced.

The abovementioned embodiment and drawings are not to limit the implementation aspect of the luminous syringe of the present invention. Appropriate variations and modification made by those who have ordinary knowledge in the art are considered to be still within the scope of the present invention.

Summing up above, the embodiment of the present invention can surely reach predetermined effect and the specific structure disclosed herein is unprecedented in the same category of product.

What is claimed is:

1. A luminous syringe, comprising:

a syringe main body having a closed front end, an opened rear end and a hollow chamber formed inside;

a hollow orifice protruding from the front end of the syringe main body and communicating with the hollow chamber;

a plunger fitted within the hollow chamber, characterized in that:

a mezzanine space is formed between an outer wall of the syringe main body and the hollow chamber, a light emitting agent and at least one catalyst tube being received within the mezzanine space;

a catalyst being contained within a tube body of the catalyst tube;

a cap being provided to close the opening formed on the mezzanine space at the rear end of the syringe main body;

an aperture being formed on the center of the cap to correspond to the hollow chamber, and the plunger being penetrated through the aperture;

wherein a side wall of the mezzanine space of the syringe main body is formed with at least one locating groove within which the catalyst tube is received.

2. The luminous syringe as claimed in claim 1, wherein the peripheral edge at the rear end of the syringe main body is formed with a fixing flange and a fixing groove is provided on the end face of the fixing flange; a notch is provided on at least one side of the fixing groove, and the cap correspondingly covers on the fixing groove of the fixing flange; the cap has a lug provided on at least one side thereof so as to be disposed correspondingly on the notch for positioning.

3. The luminous syringe as claimed in claim 2, wherein the cap further has an abutting edge formed at its bottom along the periphery of the aperture for abutting against the receiving hollow chamber of the syringe main body for positioning.

4. The luminous syringe as claimed in claim 1, wherein the syringe main body has at least one locating rib formed axially on its outer peripheral wall, and a side wall of the mezzanine space of the syringe main body is formed with at least one locating groove corresponding to the locating rib to allow the catalyst tube to be received within the locating groove.

5. The luminous syringe as claimed in claim 4, wherein the peripheral edge at the rear end of the syringe main body is formed with a fixing flange and a fixing groove is provided on the end face of the fixing flange, a notch is provided integrally on at least one side of the fixing groove, and the cap correspondingly covers on the fixing groove of the fixing flange; the cap has a lug provided on at least one side thereof so as to be disposed correspondingly on the notch for positioning.

6. The luminous syringe as claimed in claim 5, wherein the cap further has an abutting edge formed at its bottom along the periphery of the aperture for abutting against the hollow chamber of the syringe main body for positioning.

7. The luminous syringe as claimed in claim 1, wherein the peripheral edge at the rear end of the syringe main body is formed with a fixing flange and a fixing groove is provided on the end face of the fixing flange, a notch is provided integrally on at least one side of the fixing groove, and the cap correspondingly covers on the fixing groove of the fixing flange; the cap has a lug provided on at least one side thereof so as to be disposed correspondingly on the notch for positioning.

8. The luminous syringe as claimed in claim 1, wherein the cap further has an abutting edge formed at its bottom along the periphery of the aperture for abutting against the hollow chamber of the syringe main body for positioning.

9. The luminous syringe as claimed in claim 1, wherein the light emitting agent is oxalate compound and the catalyst is an activator.

10. A luminous syringe, comprising:

a syringe main body having a closed front end, an opened rear end and a hollow chamber formed inside;

a hollow orifice protruding from the front end of the syringe main body and communicating with the hollow chamber;

a plunger fitted within the hollow chamber, characterized in that:

a mezzanine space is formed between an outer wall of the syringe main body and the hollow chamber, a light emitting agent and at least one catalyst tube being received within the mezzanine space;

a catalyst being contained within a tube body of the catalyst tube;

a cap being provided to close the opening formed on the mezzanine space at the rear end of the syringe main body;

an aperture being formed on the center of the cap to correspond to the hollow chamber, and the plunger being penetrated through the aperture;

wherein the syringe main body has at least one locating rib formed axially on its outer peripheral wall, and a side wall of the mezzanine space of the syringe main body is formed with at least one locating groove corresponding to the locating rib to allow the catalyst tube to be received within the locating groove.

11. The luminous syringe as claimed in claim 10, wherein the peripheral edge at the rear end of the syringe main body is formed with a fixing flange and a fixing groove is provided on the end face of the fixing flange, a notch is provided integrally on at least one side of the fixing groove, and the cap correspondingly covers on the fixing groove of the fixing flange; the cap has a lug provided on at least one side thereof so as to be disposed correspondingly on the notch for positioning.

12. The luminous syringe as claimed in claim 11, wherein the cap further has an abutting edge formed at its bottom along the periphery of the aperture for abutting against the hollow chamber of the syringe main body for positioning.

13. A luminous syringe, comprising:

a syringe main body having a closed front end, an opened rear end and a hollow chamber formed inside;

a hollow orifice protruding from the front end of the syringe main body and communicating with the hollow chamber;

a plunger fitted within the hollow chamber, characterized in that:

a mezzanine space is formed between an outer wall of the syringe main body and the hollow chamber, a light emitting agent and at least one catalyst tube being received within the mezzanine space;

a catalyst being contained within a tube body of the catalyst tube;

a cap being provided to close the opening formed on the mezzanine space at the rear end of the syringe main body;

an aperture being formed on the center of the cap to correspond to the hollow chamber, and the plunger being penetrated through the aperture;

wherein the peripheral edge at the rear end of the syringe main body is formed with a fixing flange and a fixing groove is provided on the end face of the fixing flange, a notch is provided integrally on at least one side of the fixing groove, and the cap correspondingly covers on the fixing groove of the fixing flange; the cap has a lug provided on at least one side thereof so as to be disposed correspondingly on the notch for positioning.

* * * * *